US010697161B2

(12) United States Patent
Birmelin

(10) Patent No.: US 10,697,161 B2
(45) **Date of Patent: *Jun. 30, 2020**

(54) AERATED JET REGULATOR HAVING A FLOW RECTIFIER IN THE FORM OF A NETWORK STRUCTURE

(71) Applicant: Neoperl GmbH, Mullheim (DE)

(72) Inventor: David Birmelin, Mullheim (DE)

(73) Assignee: NEOPERL, Mullheim (DE)

( * ) Notice: Subject to any disclaimer, the term of this patent is extended or adjusted under 35 U.S.C. 154(b) by 235 days.

This patent is subject to a terminal disclaimer.

(21) Appl. No.: 15/580,763

(22) PCT Filed: Sep. 16, 2016

(86) PCT No.: PCT/EP2016/001560

§ 371 (c)(1),
(2) Date: Dec. 8, 2017

(87) PCT Pub. No.: WO2017/045762

PCT Pub. Date: Mar. 23, 2017

(65) Prior Publication Data

US 2018/0148913 A1 May 31, 2018

(30) Foreign Application Priority Data

Sep. 18, 2015 (DE) ..... 20 2015 006 618 U

(51) Int. Cl.
*E03C 1/084* (2006.01)

(52) U.S. Cl.
CPC ..... *E03C 1/084* (2013.01)

(58) Field of Classification Search
CPC ..... E03C 1/08; E03C 1/084; E03C 1/086
See application file for complete search history.

(56) References Cited

U.S. PATENT DOCUMENTS 3,138,332 A 6/1964 Gottlob
3,672,574 A 6/1972 Knapp
(Continued)

FOREIGN PATENT DOCUMENTS

CN 1434891 8/2003
CN 101701467 5/2010
(Continued)

*Primary Examiner* — Darren W Gorman
(74) *Attorney, Agent, or Firm* — Volpe and Koenig, P.C.

(57) ABSTRACT

The invention relates to a jet regulator (100) having a jet regulator housing (2), in the housing interior of which a flow straightener is provided, said flow straightener having at least one insert part (8, 9) that is insertable into the housing interior, said insert part (8, 9) having a grid structure which is formed from a set of radially oriented webs (13, 13') which intersect or are in contact with a set of concentrically encircling webs (15) at intersection points (14) or contact points, and having at least one aeration opening (4) which passes through a housing circumferential wall (3) of the jet regulator (100). The jet regulator (100) according to the invention is characterized by the fact that the flow straightener has at least one insert part (8) with radially oriented webs (13), the free web end of which protrudes beyond the outer encircling web (15) and ends at a distance from the housing inner circumference of the jet regulator housing (2) (cf. FIG. 1).

16 Claims, 8 Drawing Sheets

(56) References Cited

U.S. PATENT DOCUMENTS

| | | | | |
|---|---|---|---|---|
| 3,684,191 | A | 8/1972 | Shames et al. | |
| 4,637,552 | A | 1/1987 | Finkbeiner et al. | |
| 5,309,946 | A | 5/1994 | Ligneul | |
| 6,588,682 | B1 | 7/2003 | Flieger | |
| 6,892,964 | B2 | 5/2005 | Grether et al. | |
| 7,357,337 | B2 * | 4/2008 | Ferrari | E03C 1/08 239/428.5 |
| 7,661,608 | B2 * | 2/2010 | Grether | E03C 1/084 239/391 |
| 7,731,107 | B2 * | 6/2010 | Grether | B05B 1/18 239/500 |
| 7,757,969 | B2 | 7/2010 | Lacher et al. | |
| 9,016,602 | B2 | 4/2015 | Grether | |
| 9,534,361 | B2 * | 1/2017 | Grether | E03C 1/084 |
| 2006/0011748 | A1 | 1/2006 | Ferrari | |
| 2008/0169361 | A1 * | 7/2008 | Lacher | E03C 1/084 239/428.5 |
| 2013/0008980 | A1 | 1/2013 | Grether | |
| 2018/0148913 | A1 | 5/2018 | Birmelin | |

FOREIGN PATENT DOCUMENTS

| | | | |
|---|---|---|---|
| CN | 201933557 | | 9/2010 |
| CN | 201969506 | | 9/2011 |
| CN | 202767190 | | 3/2013 |
| CN | 205857303 | | 1/2017 |
| CN | 106545062 | | 3/2017 |
| DE | 3404662 | | 8/1985 |
| DE | 19852411 | | 5/2000 |
| DE | 102005001419 | | 5/2006 |
| DE | 102006009828 | B3 | 6/2007 |
| DE | 102010012326 | | 9/2011 |
| DE | 102010048701 | A1 | 3/2012 |
| EP | 0721031 | | 7/1996 |
| EP | 1001095 | | 5/2000 |
| EP | 1616999 | A1 | 1/2006 |
| EP | 2345765 | | 7/2011 |
| FR | 25622202 | | 10/1985 |

* cited by examiner

AERATED JET REGULATOR HAVING A FLOW RECTIFIER IN THE FORM OF A NETWORK STRUCTURE

BACKGROUND

The invention relates to a jet regulator having a jet regulator housing, in the housing interior of which a flow straightener is provided, said flow straightener having at least one insert part that is insertable into the housing interior, said insert part having a grid structure which is formed from a set of radially oriented webs which intersect or are in contact with a set of concentrically encircling webs at intersection points or contact points, and having at least one aeration opening which passes through a housing circumferential wall of the jet regulator.

Various jet regulators have already been created, which can be mounted at the water outlet of a sanitary outlet fitting in order to form the water emerging there from the outlet fitting into a homogeneous, non-splashing water jet. A distinction is drawn here between non-aerated and aerated jet regulator embodiments. In aerated jet regulators, the water flowing therethrough is intermixed with ambient air in the regulator housing of the jet regulator, in order to allow the water to emerge as a gentle bubbling water jet.

To this end, such aerated jet regulators have a jet splitter in their jet regulator housing, said jet splitter dividing the water flowing in into a multiplicity of individual jets. These individual jets have their speed increased in the jet splitter, such that a negative pressure arises on the outflow side of the jet splitter in accordance with the Bernoulli equation. Aeration openings are provided in the circumferential wall of the jet regulator housing on the outflow side of the jet splitter, said aeration openings passing through the circumferential wall. The negative pressure that arises on the outflow side of the jet splitter draws in the ambient air, which passes through the aeration openings and into the housing interior of the jet regulator housing and is intermixed with the individual jets there, before the individual jets intermixed with air in this way are formed into an aerated overall jet in a flow straightener.

This flow straightener usually is formed of at least two insert parts which are insertable in the housing interior of the jet regulator housing. These insert parts each have a lattice or grid structure which initially divides the aerated individual jets flowing therethrough even further. However, the lattice- or grid-like insert parts that form the flow straightener also represent an obstacle to flow, upstream of which the water flowing through can back up. Undesired noises occur occasionally in the process. These disruptive noises, which are perceptible as gurgling or groaning noise, are caused by the build-up at intervals of a film of water in the aeration openings, which are briefly closed by this film of water. Due to the negative pressure on the outflow side of the jet splitter in the region of the aeration openings, this film of water breaks down again immediately after it has formed and is drawn into the throughflow region of the jet regulator. The constant high-frequency build-up and breakdown of the film of water results in these flow noises or disruptive noises. The insert parts of the flow straightener, which at the same time form an obstacle to flow, result in a flow backup at the outer attachment of the lattice or grid structure in the region of the external retaining ring. A kind of "ramp" forms there, which causes the water to back up upstream of the aeration openings. During the build-up and breakdown of the film of water in the housing interior upstream of the aeration openings, small quantities of water also regularly emerge from the aeration openings in the form of aerosol water or splashing water. This emerging water can result in increased limescale formation and in external soiling of the jet regulator or of the outlet nozzle that accommodates the jet regulator.

SUMMARY

Therefore, the objective exists, in particular, of creating a jet regulator in which such flowing noises, and additional limescale formation or soiling in the outer circumferential region of the regulator housing of the jet regulator, are avoided.

This objective is achieved according to the invention, in the jet regulator of the type mentioned at the beginning, in particular in that the flow straightener has at least one insert part with radially oriented webs, the free web end of which protrudes beyond the outer encircling web and ends at a distance from the housing inner circumference of the jet regulator housing.

The jet regulator according to the invention has a jet regulator housing, in the housing interior of which a flow straightener is provided. The purpose of this flow straightener is to re-homogenize the individual jets that come from the jet regulator and are then intermixed with ambient air and to form them into a homogeneously emerging water jet. To this end, the flow straightener has an insert part which is insertable into the housing interior and has a grid structure which is formed from a set of radially oriented webs which intersect a set of webs, concentrically encircling one another, at intersection points or are in contact therewith at contact points. The water flowing through the housing interior is guided through this structure in the form of a spider's web, wherein the water is guided at the web walls, extending in the throughflow direction, of the grid structure and is formed into a homogeneously emerging, non-splashing water jet. The flow straightener has at least one insert part, the grid structure of which has radially oriented webs, the outwardly directed free web end of which protrudes beyond the outer, annularly encircling web and ends at a distance from the housing inner circumference of the jet regulator housing such that at least one drain opening remains between these free web ends and the housing inner circumference, said drain opening preventing any backup, associated with undesired generation of noise, of the water flowing through upstream of the flow straightener and in particular in the region of aeration openings.

Not all of the radially oriented webs of the at least one insert part have to end at a distance from the housing inner circumference of the jet regulator; rather, some of these radially oriented webs can also reach as far as the housing inner circumference of the jet regulator housing. At any rate, it is advantageous when, of the radially oriented webs of the at least one insert part, at least the webs that extend in the direction of the at least one aeration opening have a free web end which ends at a distance from the housing inner circumference of the jet regulator housing. In this embodiment, the webs that are oriented approximately in the direction of the at least one aeration opening and are possibly arranged in a plane oriented beneath this at least one aeration opening are thus dimensioned such that they end at a distance from the housing inner circumference of the jet regulator housing. However, an embodiment is preferred in which all of the radially oriented webs of this at least one insert part end at a distance from the housing inner circumference of the jet regulator housing.

The flow straightener of the jet regulator according to the invention can optionally also have a plurality of insert parts configured with an identical construction. However, an embodiment is preferred in which the flow straightener has at least two insert parts that are preferably configured differently, wherein, to this end, the flow straightener has, in addition to the at least one first insert part, at least one second insert part that is insertable into the housing interior of the jet regulator housing.

In order that the at least one insert part that follows the first insert part in the throughflow direction can also contribute toward calming and homogenizing the water flowing through, it is advantageous when the at least one second insert part is connected downstream of the at least one first insert part in the throughflow direction and has a lattice or grid structure made up of webs that intersect one another at intersection points or are in contact at contact points.

In order to configure the drain openings kept free between the free web ends of the radial webs provided on the first insert part and the housing inner circumference with a free opening cross section that is as large as possible, it is expedient when the at least one first insert part is configured without a retaining ring and when, in the plane of the grid structure, the free web ends determine the outer contour or the outer circumference of the first insert part.

By contrast, it may be advantageous when the at least one second insert part has an encircling outer retaining ring, said retaining ring bounding the lattice or grid structure of this insert part.

In this case, it is expedient when the lattice or grid structure of the at least one second insert part acts on the inner circumference of the retaining ring of the latter.

In a preferred embodiment of the invention, an anti-rotation device is provided at least between the first insert part and the housing inner circumference.

In order to always provide the drain openings, provided in the lattice or grid structure of at least the first insert part, upstream of the aeration openings, it is advantageous when at least the first insert part is insertable into the housing interior in a manner secured against rotation in the circumferential direction.

In order to be able to intermix the water flowing through the jet regulator according to the invention with ambient air and in order, to this end, to always keep a sufficiently large amount of ambient air in the housing interior of the jet regulator housing, it is advantageous when the jet regulator has a jet splitter which is connected upstream of the flow straightener in the flow direction, and when the at least one aeration opening is arranged at the housing inner circumference in an annular zone provided between the flow straightener and the jet splitter. In this case, the jet splitter can be configured for example as a perforated plate which has throughflow holes arranged for example in concentric circles. However, it is also possible for this jet splitter to be configured in a cup-shaped manner, wherein the cup bottom forms a baffle and wherein throughflow holes that are spaced apart from one another in the circumferential direction are provided in the circumference of this cup shape, the water flowing in being divided into the required individual jets in said throughflow holes.

In order to provide for the water flowing through to also be divided in the region of the drain openings provided at least in the first insert part, it is advantageous when webs are retained on the inner circumferential side of the retaining ring of the second insert part, said webs being arranged on the first insert part in continuation of the webs, oriented radially and preferably in the direction of an aeration opening, in the jet regulator longitudinal direction.

In this case, in a preferred embodiment of the invention, the webs that are provided on the inner circumferential side of the retaining ring of the second insert part and are arranged on the first insert part in continuation of the radially oriented webs are configured as web stubs, the stub ends of which reach approximately as far as the free web ends of the webs assigned to the first insert p art.

Since the flow straightener and the webs of the at least one insert part thereof form obstacles to flow, at which the water flowing in can also be at least partially thrown back, there is the risk of water thrown back in this way emerging through the aeration openings in the jet regulator and impairing the function of the jet regulator. In a preferred embodiment of the invention, therefore, a splash guard ring is provided, which is arranged in the housing interior of the jet regulator housing, between the at least one aeration opening and the flow straightener. This splash guard ring keeps the water droplets thrown back by the flow straightener and the webs of the at least one insert part thereof away from the at least one aeration opening in the jet regulator housing.

In this case, the proper function of said splash guard ring and the correct position of the splash guard ring in the housing interior is favored when the outer circumferential periphery of the splash guard ring has at least been moved into the vicinity of the housing inner circumference of the jet regulator housing.

In this case, in a structurally simple embodiment of the invention that is producible with comparatively little effort, anti-rotation protrusions that are spaced apart from one another preferably regularly in the circumferential direction are provided on the outer circumference of the first insert part, said anti-rotation protrusions connecting the splash guard ring and the grid structure of the first insert part integrally together.

If an anti-rotation device is provided between the at least one insert part of the flow straightener and the jet regulator housing, it is advantageous when said anti-rotation device has anti-rotation protrusions which protrude from the outer circumference of the at least one insert part, and when said anti-rotation protrusions protrude into anti-rotation grooves or indentations in the housing inner circumference of the jet regulator housing.

In this case, in one embodiment of the invention, the free outer end of at least the webs of the first insert part that are oriented for example radially in the direction of the at least one aeration opening ends at a distance upstream of the retaining ring surrounding the grid structure of said insert part, if the first insert part has such a retaining ring.

However, it is also possible for the lattice or grid structure of the flow straightener to be integrally formed on the inner circumference of the housing wall of the jet regulator housing and to be retained otherwise there.

In order to be able to attach the grid structure to the retaining ring of the first insert part, it may be expedient when said grid structure is retained on the inner circumference of the retaining ring of the first insert part in the regions between adjacent aeration openings.

The water flowing through can be divided even further particularly well in the flow straightener and subsequently formed into a homogeneous overall jet when the second insert part also has a grid structure formed from sets of webs that intersect or are in contact with one another, and when the intersection points or contact points formed by the webs of the second insert part are arranged in such an offset manner with respect to the grid structure of the first insert part that these intersection points or contact points are arranged beneath throughflow openings, bounded by adjacent webs, of the first insert part.

In a preferred embodiment of the invention, the at least one drain opening is arranged on the inner side of a retaining ring that engages around the outer circumference of the lattice or grid structure of an insert part.

In order to prevent uncontrolled rogue streams in the annular gap between the retaining ring of the insert parts, for the one part, and the housing inner circumference of the jet regulator housing, for the other part, it is advantageous when at least the insert part, arranged on the inflow side, of the flow straightener bears circumferentially, at least with the inflow-side outer circumferential peripheral region of its retaining ring, against the inner circumference of the jet regulator housing. To this end, the retaining ring of said insert part can have an outer circumference that is widened regionally counter to the flow direction.

BRIEF DESCRIPTION OF THE DRAWINGS

Further developments of the invention can be gathered from the claims in conjunction with the description and from the figures. The invention is described in more detail in the following text on the basis of a preferred exemplary embodiment.

In the figures.

DETAILED DESCRIPTION OF THE PREFERRED EMBODIMENTS

Figure 1:
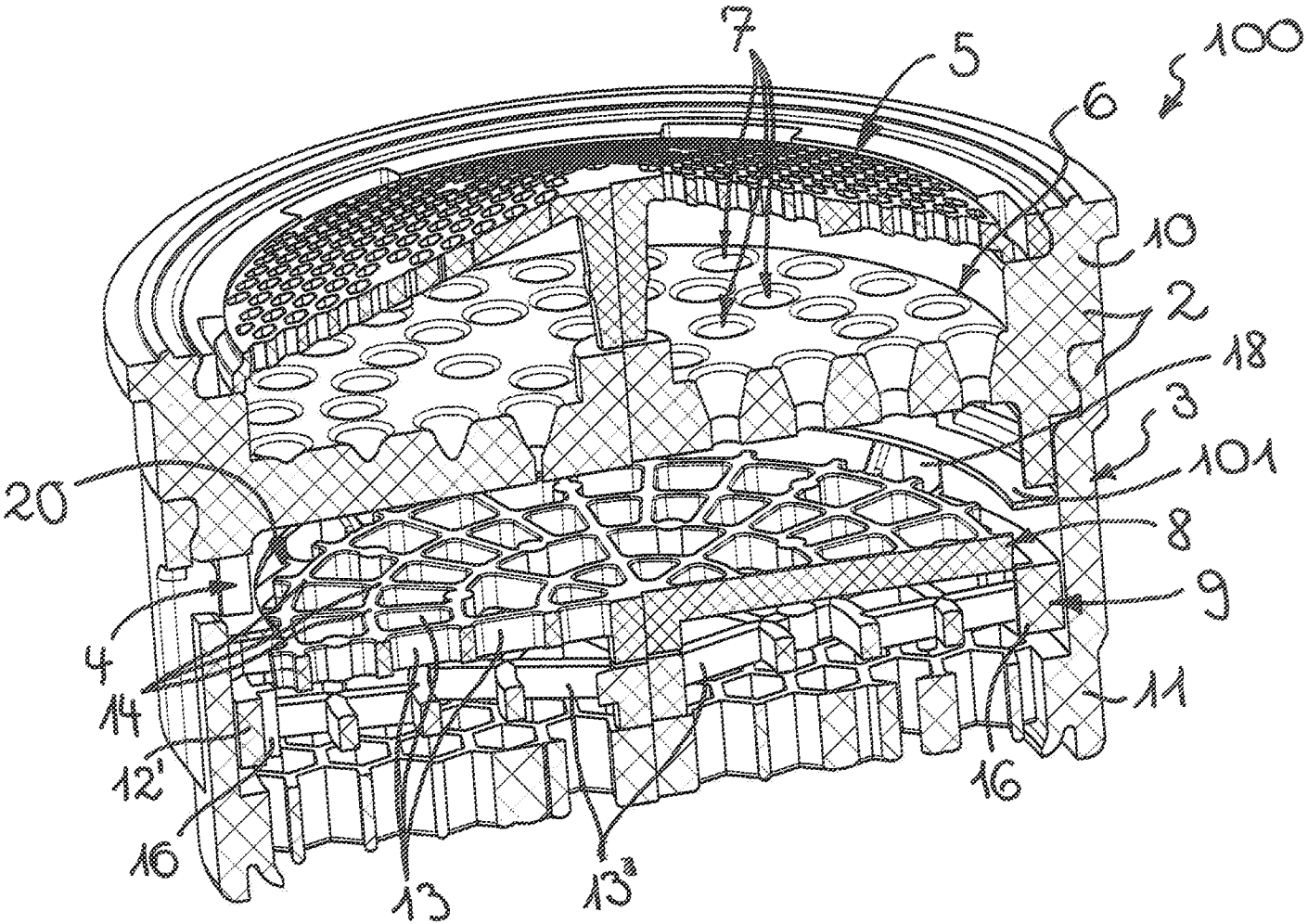
FIG. 1 shows a jet regulator, illustrated in longitudinal section, which has an inflow-side dome screen or filter screen, a jet splitter in the form of a perforated plate, and a flow straightener downstream thereof in the throughflow direction, said flow straightener having a first and a second insert part which are insertable into the housing interior of the jet regulator housing.
Figure 2:
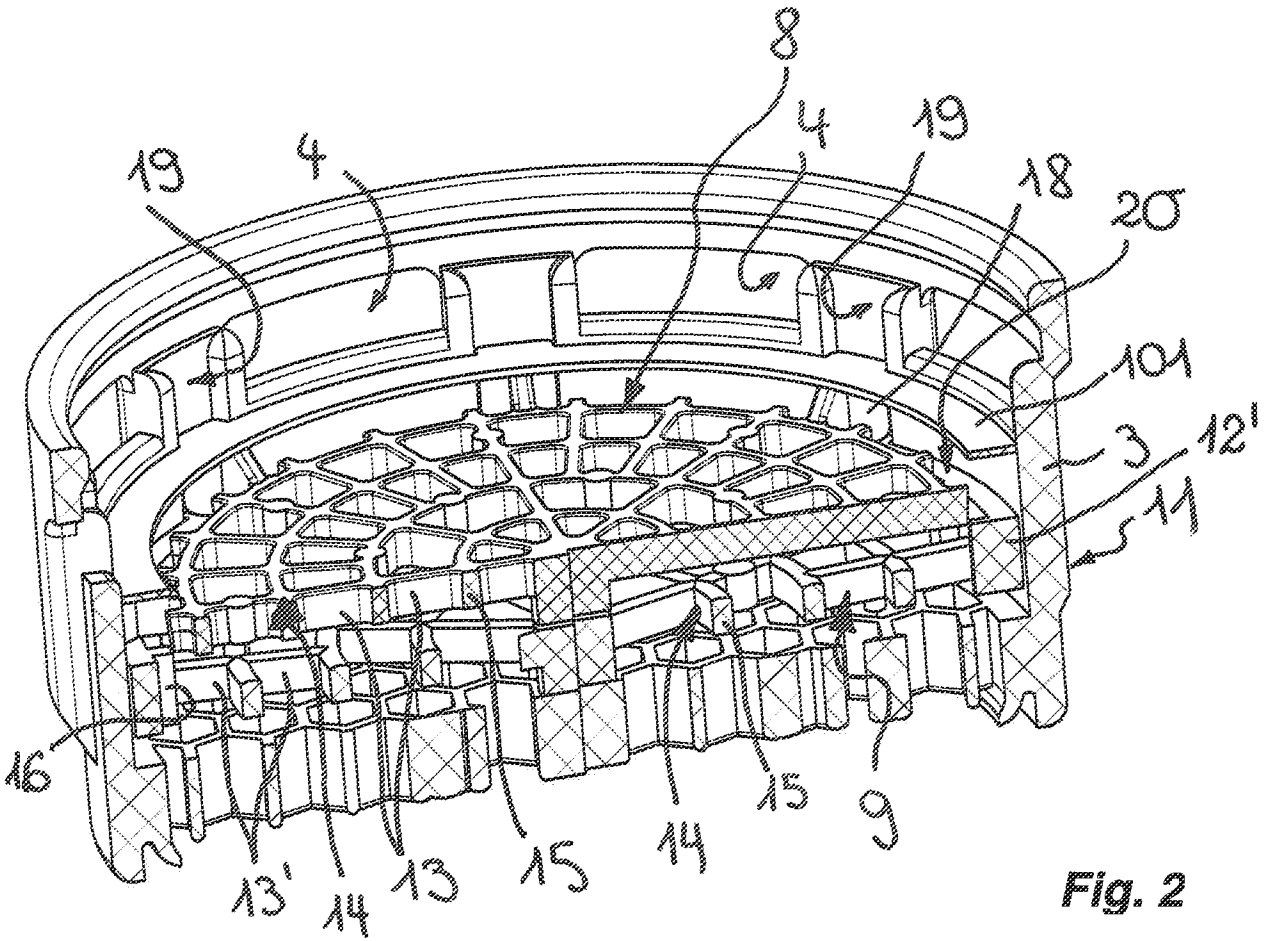
FIG. 2 shows the insert parts, inserted into the jet regulator housing, of the jet regulator according to FIG. 1 in a longitudinal section.
Figure 3:
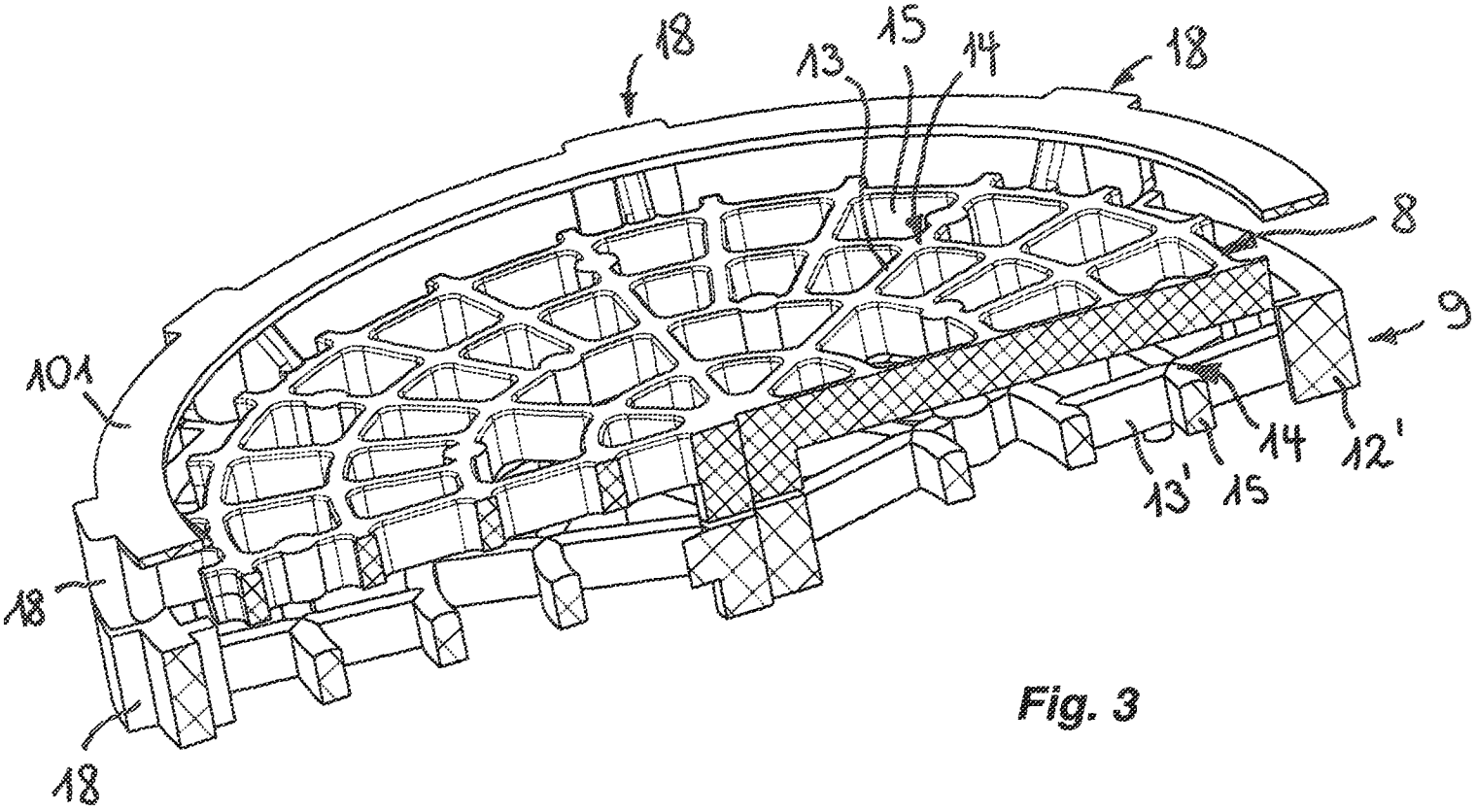
FIG. 3 shows the insert parts, located one above the other in their insertion position, of the jet regulator shown in FIG. 1.
Figure 4:
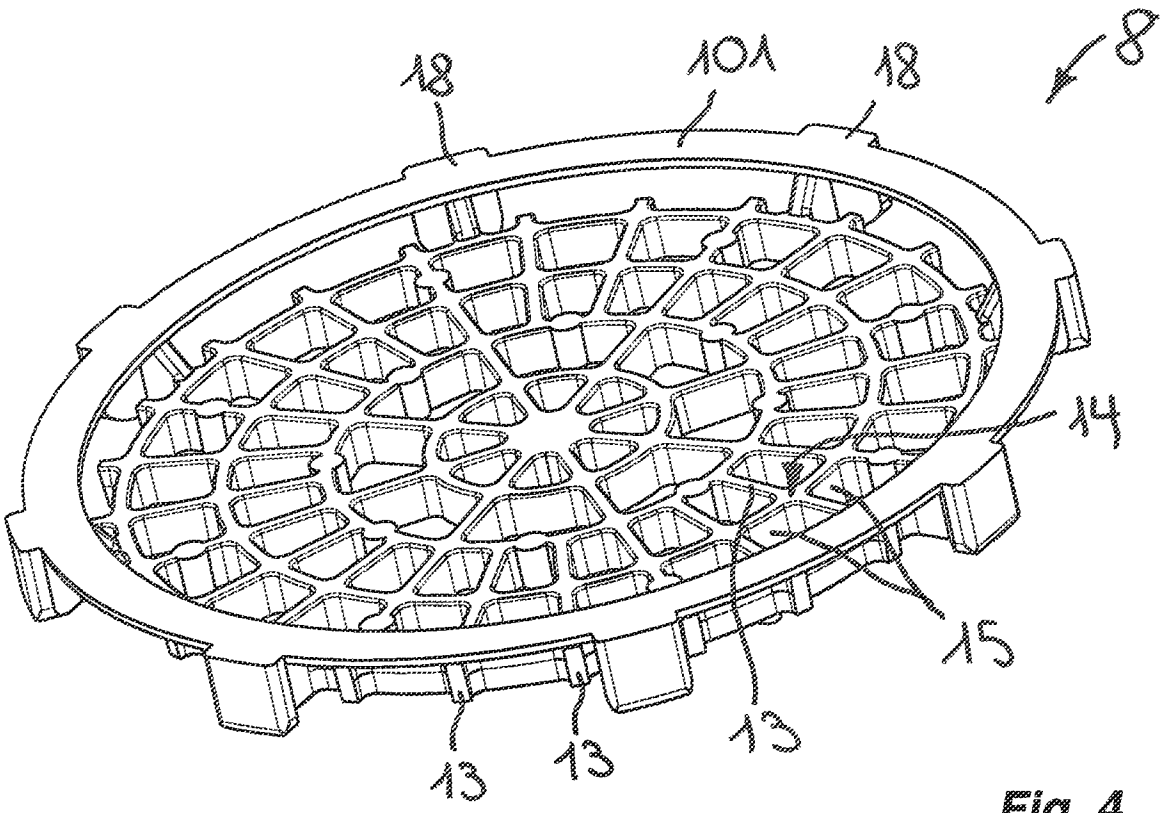
FIG. 4 shows the first insert part, at the front in the throughflow direction, of the jet regulator according to FIG. 1 on its own in a perspective view.
Figure 5:
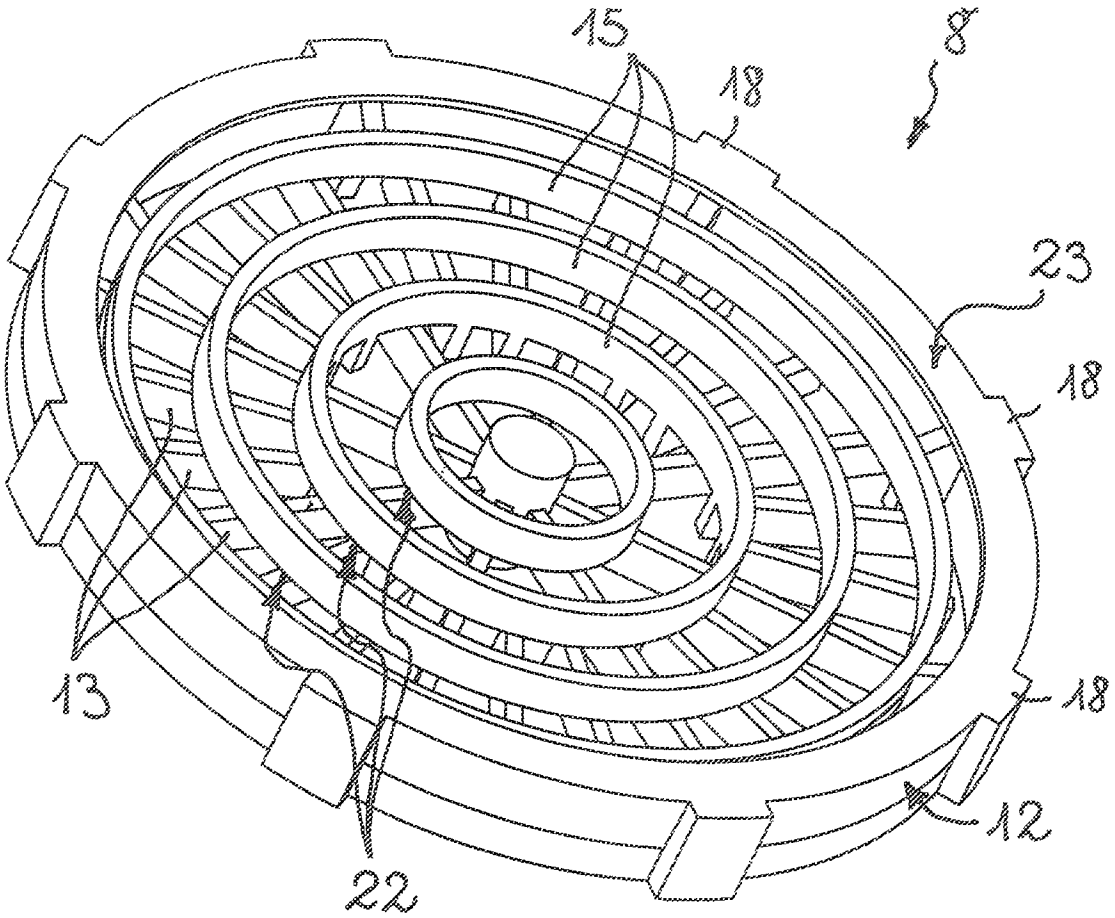
FIG. 5 shows a perspective plan view of an alternatively configured inflow-side insert part, wherein the grid structure of said insert part is formed from webs that are in contact with one another at contact points.
Figure 6:
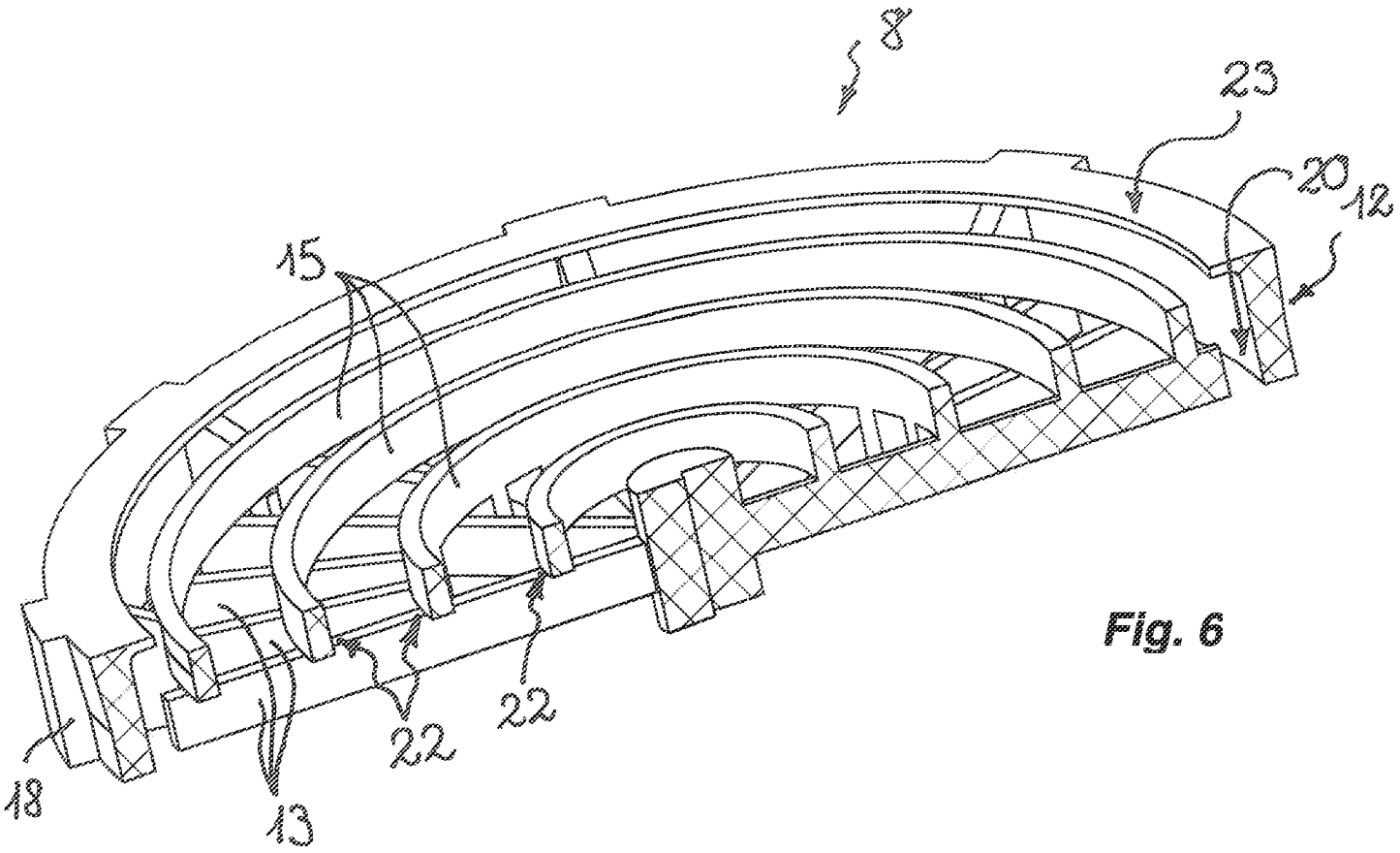
FIG. 6 shows the insert part from FIG. 5 in a perspective plan view illustrated in section.
Figure 7:
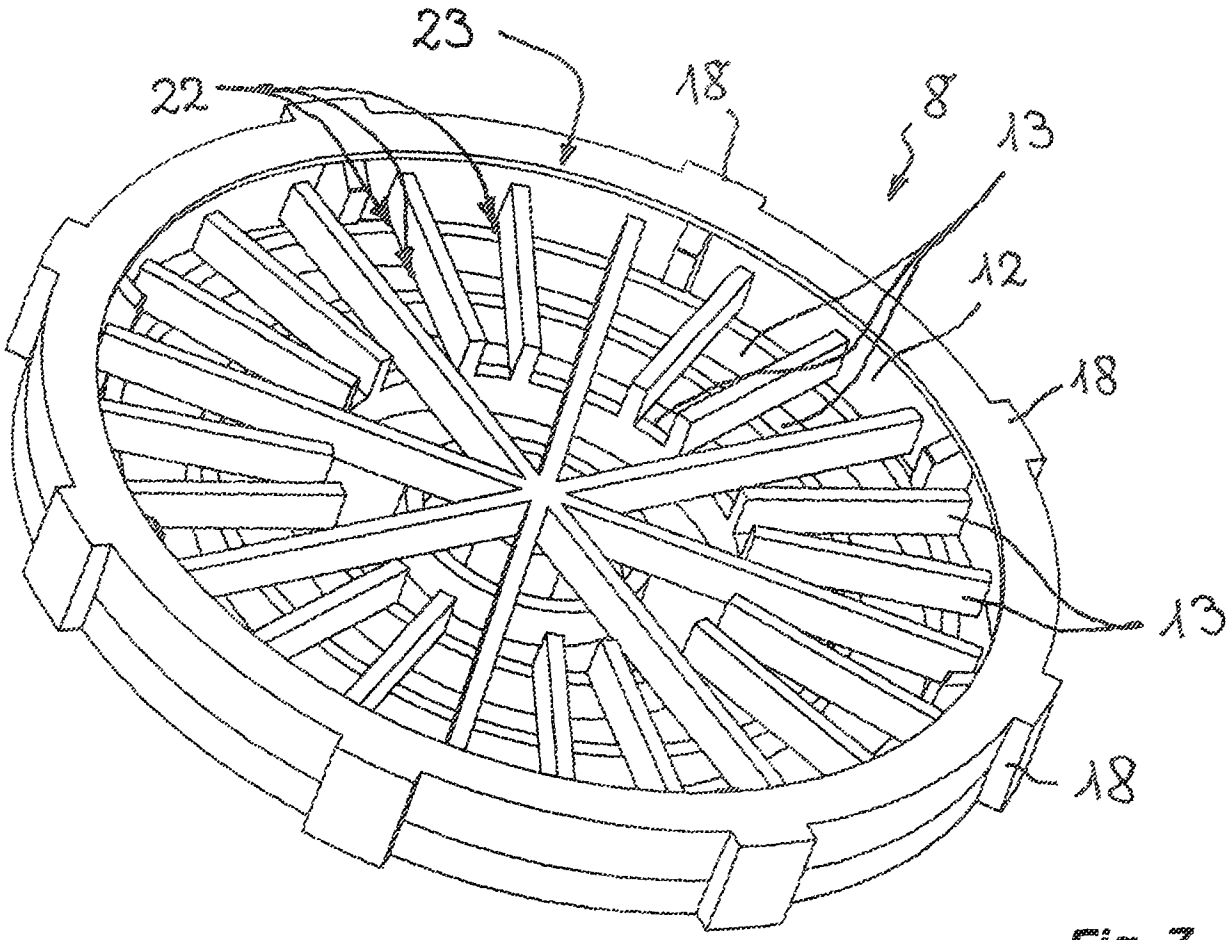
FIG. 7 shows a perspective plan view of a further, alternatively configured inflow-side insert part, wherein the grid structure of said insert part, too, is formed from webs that are in contact with one another at contact points.
Figure 8:
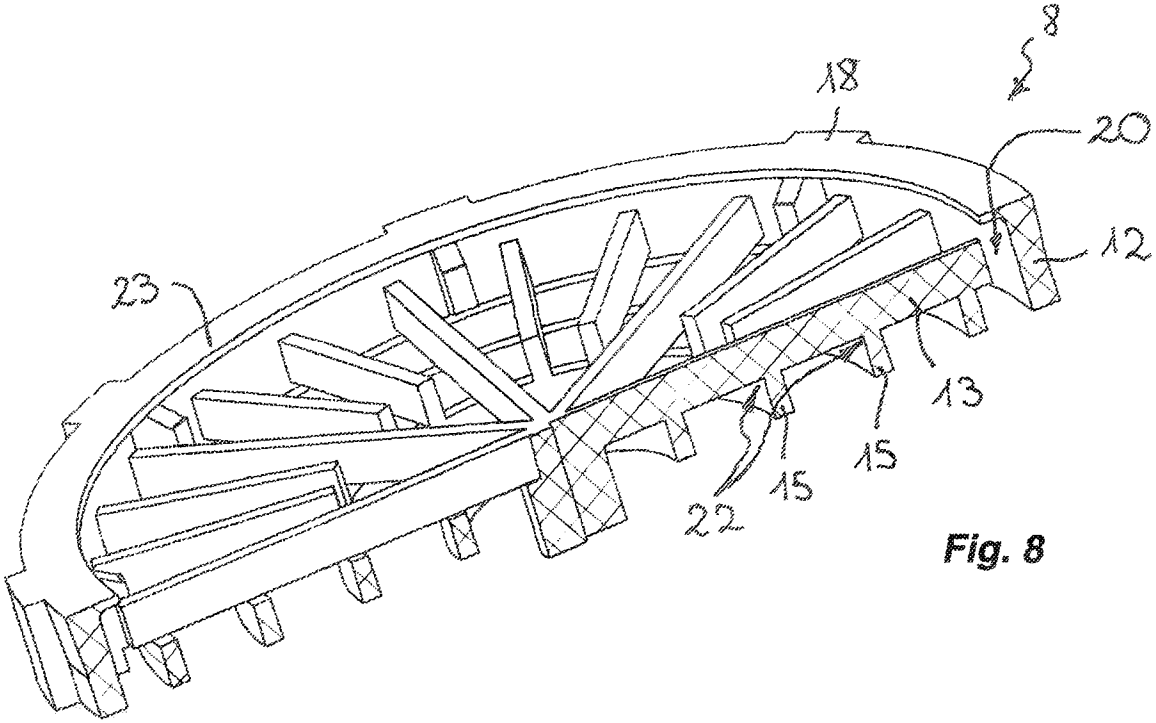
FIG. 8 shows the insert part from FIG. 7 in a perspective plan view illustrated in section.

FIGS. 1 to 4 illustrate a jet regulator 100 which is mountable at the water outlet of a sanitary outlet fitting in order to form the water emerging from the outlet fitting (not shown further here) into a homogeneous, non-splashing water jet. The jet regulator 100 has a jet regulator housing 2 with a housing circumferential wall 3 that is round in cross section in this case. In order to be able to intermix the water flowing through the jet regulator 100 with ambient air, and in order to form the emerging water jet as a gentle bubbling water jet, aeration openings 4 are provided which pass through the housing circumferential wall 3—in a manner distributed preferably at regular spacing in the circumferential direction around the housing circumference of the jet regulator housing 2—and lead into the housing interior of the jet regulator housing 2.

In order to stop the limescale deposits and similar dirt particles possibly contained in the water flowing in from passing into the jet regulator housing 2, where these dirt particles get caught and can result in functional disruptions, the jet regulator 100 is releasably connected, on the inflow side, with a dome screen 5, which is conical here. Provided beneath the dome screen 5, on the inflow side of the jet regulator 100, is a jet splitter 6. The jet splitter 6 arranged in the jet regulator housing 2 is configured here as a perforated plate, which has a multiplicity of throughflow openings 7 which are arranged in concentric circles. The jet splitter 6 divides the water flowing in into a multiplicity of individual jets. These individual jets have their speed increased in the throughflow openings 7 of the jet splitter 6, such that a negative pressure arises on the outflow side of the jet splitter 6. The aeration openings 4 provided in the housing circumferential wall 3 of the jet regulator housing 2 are arranged there in an annular zone on the outflow side of the jet splitter 6. The negative pressure that arises on the outflow side of the jet splitter 6 draws the ambient air through the aeration openings 4 and into the housing interior of the jet regulator housing 2, where this ambient air can be intermixed with the individual jets created in the jet splitter 6, before the individual jets intermixed with air in this way are formed into an aerated overall jet in a flow straightener connected downstream of the jet splitter 6.

The flow straightener of the jet regulator 100 is formed here of two insert parts 8, 9 which are insertable into the housing interior of the jet regulator housing 2. The jet regulator housing 2 is, to this end, configured in two parts and has a first housing part 10 and a cup-shaped second housing part 11. While the jet splitter 6 configured as a perforated plate is integrally formed in the first housing part 10, the insert parts 8, 9 of the flow straightener have been inserted into the second housing part 11. The insert parts 8, 9 of the flow straightener are retained in the housing interior when the housing parts 10, 11 are connected releasably together.

The insert parts 8, 9 of the jet regulator 100 in this case each have a grid structure which first of all divides the aerated individual jets flowing through even further, wherein the individual jets that come from the jet splitter 6 and are intermixed with ambient air are guided between the webs of the insert parts 8, 9 and are shaped into a homogeneously emerging, non-splashing and gently bubbling overall jet. It is clear from a comparison of FIGS. 1 to 4 that the insert parts 8, 9 of the jet regulator 100 have a grid structure made up of webs 13, 15 that intersect one another at intersection points 14. These grid structures of the insert parts 8, 9 illustrated in FIGS. 1 to 4 are formed here by a set of radially oriented webs 13, 13' which intersect a set of webs 15 arranged concentrically with one another at intersection points 14.

It is clear from a comparison of FIGS. 1 to 4 that, at least in the case of the inflow-side first insert part 8, the free outer end of the webs 13 that are oriented radially in the direction of an aeration opening 4 end at a distance upstream of the housing inner circumference of the jet regulator housing 2. In this way, a drain opening 20 that extends at least over an associated aeration opening 4 is formed in the grid structure of the first insert part 8 of the flow straightener. This drain opening 20 is formed, in the jet regulator 100 illustrated here, between the grid structure of the first insert part 8 and the housing inner circumference. Since the water flowing to the flow straightener can thus pass through these drain openings 20 in the region of the aeration openings 4 without the water flowing in backing up there upstream of the flow straightener, undesired flow noises in the region of the aeration openings 4 and the build-up and breakdown of a water film at intervals in this region are prevented.

It is apparent from FIGS. 1 to 4 that the second insert part 9 likewise has a grid structure formed from sets of mutually intersecting webs 13', 15, wherein the intersection points 14 formed by the webs 13', 15 of the second insert part 9 are arranged in such an offset manner with respect to the grid structure of the first insert part 8 that these intersection points 14 of the second insert part 9 are arranged beneath throughflow openings, bounded by adjacent webs 13, 15, of the first insert part 8. In this case, webs 15 are retained on the inner circumference of a retaining ring 12 of the second insert part 9, said webs 15 being arranged in the plane of the grid structure of the second insert part 9 but—as seen in the throughflow direction—in continuation of the webs 13, oriented radially in the direction of an aeration opening 4, on the first insert part 8. The webs provided on the inner circumference of the retaining ring 12 of the second insert part 9 and arranged in continuation of the radially oriented webs 13 on the first insert part 8 are configured here as web stubs 16, the stub ends of which—as is clear from FIGS. 1-4—reach as far as the free web ends of the webs 13 assigned to the first insert part 8. This ensures that the water that flows through the flow straightener is also divided even further in the region of the drain openings 20.

In order to ensure the offset arrangement of the grid structures provided in the insert parts 8, 9, the insert parts 8, 9 of the jet regulators 1, 100 are inserted into the housing interior of the jet regulator housing 2 in a manner secured against rotation in the circumferential direction. To this end, an anti-rotation device is provided in each case between the insert parts 8, 9 and the housing inner circumference.

To this end, the insert parts 8, 9 have at least one anti-rotation protrusion 18 on their outer circumference, said anti-rotation protrusion 18 engaging in each case in a securing groove 19, oriented in the jet regulator longitudinal direction, in the inner circumference of the housing circumferential wall 3.

The first insert part 8 of the jet regulator 100 shown in FIGS. 1 to 4 does not have an outer encircling retaining ring—rather, the front first insert part 8 in the throughflow direction has the radially oriented webs, the free web ends of which protrude beyond the outer encircling web 15 and end at a distance from the housing inner circumference of the jet regulator housing 2. The flow straightener in the jet regulator 100 has, in addition to this one first insert part 8, also the second insert part 9, which is likewise insertable into the housing interior of the jet regulator housing. This second insert part 9 is connected downstream of the first insert part 8 in the throughflow direction and in this case likewise has a grid structure made up of the webs 13', 15 intersecting one another at intersection points 14. While the first insert part 8 in the jet regulator 100 is configured without a retaining ring, the second insert part 9 thereof has, by contrast, the encircling outer retaining ring 12', which bounds the grid structure of this second insert part 9.

In order to avoid any throwing back of the water droplets striking the webs 13, 15 in particular of the first insert part 8 and to prevent water droplets thrown back in this way from being able to emerge unintentionally from the aeration openings 4 in the jet regulator housing 2, a flat splash guard ring 101 is provided in the jet regulator 100, said splash guard ring 101 being arranged in the housing interior of the jet regulator 100, between the at least one aeration opening 4 and the flow straightener. In this case, the outer circumferential periphery of this splash guard ring 101 bears against the housing inner circumference of the jet regulator housing 2 or has at least been moved into the vicinity of the housing inner circumference of the jet regulator housing 2. The splash guard ring 101 arranged at a distance above the grid structure of the first insert part 8 is integrally connected to the front first insert part 8, on the inflow side, of the flow straightener via the anti-rotation protrusions 18. These anti-rotation protrusions 18 connect the splash guard ring 101 and the grid structure of the first insert part 8 integrally together.

As is apparent in FIG. 1, a lattice or grid structure is integrally formed on the outflow side of the jet regulator housing 2, and in particular the lower second housing part 11 thereof. This structure integrally formed on the outflow side is configured as a honeycomb-like grid structure 1 in the jet regulator 100 illustrated here, wherein this integrally formed structure 1 forms the outlet end face of the jet regulator 100. Since the jet regulator 100 has such an integrally formed lattice or grid structure on the outlet end face of its jet regulator housing 2, the insert parts 8, 9 are prevented from being pushed up in the jet regulator housing 2 from the outlet end face of the jet regulator 100.

FIGS. 5 to 8 illustrate alternative embodiments of an insert part by way of inflow-side insert parts 8 illustrated by way of example. As can be gathered from FIGS. 5 to 8, the at least one insert part 8 or at least one of the insert parts 8, 9 can have a lattice structure and in particular—as here—a grid structure made up of webs 13, 15 that are in contact with one another at contact points 22, wherein, here too, a set of concentrically encircling webs 15 is contact with the webs 13 of a set of radial webs which extend in a plane therebeneath or thereabove. Just like the webs that are illustrated above and intersect one another at intersection points 14, the webs 13, 15 are connected integrally together here at contact points 22. While, in the exemplary embodiment illustrated in FIGS. 5 and 6, the concentric webs 15 are arranged in an inflow-side plane and the webs 13 connected integrally thereto are arranged in an outflow-side plane, in the exemplary embodiment illustrated in FIGS. 7 and 8, by contrast, the radial webs 13 are arranged in an inflow-side plane while the concentrically encircling webs 15 are provided in an outflow-side plane.

The insert parts 8 illustrated in FIGS. 5 to 8, which each show the first insert part 8, in the throughflow direction, of the flow straightener provided in the jet regulator housing 2, have an external retaining ring 12 which has, on the inflow side, an integrally formed splash guard ring 23 which projects radially inward. At least the radially oriented webs 13 arranged in the region beneath in each case one aeration opening 4 have a free web end which protrudes beyond the outer encircling web 15 but ends at a distance from the retaining ring 12 and thus also from the housing inner circumference of the jet regulator housing 2, and as a result form a drain opening 20 that extends in the circumferential direction over the at least one aeration opening 4.

LIST OF REFERENCE SIGNS

1 Integrally formed lattice or grid structure
2 Jet regulator housing
3 Housing circumferential wall
4 Aeration opening
5 Dome screen
6 Jet splitter
7 Throughflow openings
8 First insert part
9 Second insert part
10 First housing part
11 Second housing part
12' Retaining ring
13, 13' Webs
14 Intersection points
15 Concentric webs
16 Web stubs
18 Anti-rotation protrusions
19 Securing groove
20 Drain opening
22 Contact point
23 Splash guard ring
100 Jet regulator
101 Splash guard ring

The invention claimed is:

1. A jet regulator (100) comprising: a jet regulator housing (2) having a housing interior, a flow straightener located in the housing interior, said flow straightener having at least one insert part (8, 9) that is insertable into the housing interior, a first of said at least one insert part (8, 9) having a grid structure which is formed from a set of radially oriented webs (13, 13') which intersect or are in contact with a set of concentrically encircling webs (15) at intersection points or contact points, at least one aeration opening (4) which passes through a housing circumferential wall (3) of the jet regulator (100), wherein each of the radially oriented webs (13) includes a free web end that protrudes beyond an outer one of the concentrically encircling webs (15) and ends at a distance from a housing inner circumference of the jet regulator housing (2).

2. The jet regulator as claimed in claim 1, wherein the at least one insert part includes, in addition to the first of the at least one insert part (8), a second insert part (9) that is insertable into the housing interior of the jet regulator housing (2).

3. The jet regulator as claimed in claim 2, wherein the second insert part (9) is connected downstream of the first of the at least one insert part (8) in a throughflow direction and has a lattice or grid structure made up of webs (13, 13'; 15) that intersect one another at intersection points (14) or are in contact at contact points (22).

4. The jet regulator as claimed in claim 3, wherein at least one of the first insert part (8) or the second insert part (9) has an encircling outer retaining ring (12'), said retaining ring (12') bounding the lattice or grid structure of said at least one of said first or second insert part (9).

5. The jet regulator as claimed in claim 4, wherein the lattice or grid structure acts on an inner circumference of the retaining ring (12') of the at least one insert part (9).

6. The jet regulator as claimed in claim 1, further comprising an anti-rotation device provided at least between the first of the at least one insert part (8) and the housing inner circumference.

7. The jet regulator as claimed in claim 1, further comprising a jet splitter (6) connected upstream of the flow straightener in a flow direction, and the at least one aeration opening (4) is arranged at the housing inner circumference in an annular zone provided between the flow straightener and the jet splitter (6).

8. The jet regulator as claimed in claim 2, wherein the second insert part (9) also has a grid structure formed from webs (13, 13'; 15) that intersect or are in contact with one another, and the intersection points (14) or contact points (22) formed by the webs (13, 13'; 15) of the second insert part are arranged in such an offset manner with respect to the grid structure of the first insert part (8) that said intersection points (14) or contact points (22) are arranged beneath throughflow openings, bounded by adjacent ones of the webs (13, 15), of the first insert part (8).

9. The jet regulator as claimed in claim 4, further comprising a splash guard ring (23; 101) that is at least one of: arranged in the housing interior of the jet regulator housing (2), between the at least one aeration opening (4) and the flow straightener, or retained or integrally formed on the retaining ring.

10. The jet regulator as claimed in claim 9, wherein an outer circumferential periphery of the splash guard ring (23; 101) bears against the housing inner circumference of the jet regulator housing (2) or is moved into a vicinity of the housing inner circumference.

11. The jet regulator as claimed in claim 9, wherein the splash guard ring is connected integrally to the first insert part (8), on an inflow side, of the flow straightener.

12. The jet regulator as claimed in claim 9, further comprising at least one anti-rotation protrusion (18) on an outer circumference of the at least one insert part, said at least one anti-rotation protrusion (18) protruding into at least one anti-rotation groove or indentation (19) located in an inner circumference of the jet regulator housing (2).

13. The jet regulator as claimed in claim 12, wherein the at least one anti-rotation protrusion is a plurality of anti-rotation protrusions (18), which are spaced apart from one another in a circumferential direction on an outer circumference of at least the first insert part (8).

14. The jet regulator as claimed in claim 12, wherein the at least one anti-rotation protrusion (18) provided on the first of the at least one insert part (8) connects the splash guard ring (101) and the grid structure of the first insert part (8) integrally together.

15. The jet regulator as claimed in claim 1, further comprising at least one web-free drain opening (20) on the first of the at least one insert part (8) between the free web ends of the radially oriented webs (13) thereof and the housing inner circumference of the jet regulator housing (2), and the at least one drain opening (20) is arranged beneath the at least one aeration opening (4) in a flow direction.

16. The jet regulator as claimed in claim 1, further comprising a lattice or grid structure (1) integrally formed on an outflow side of the jet regulator housing (2), said lattice or grid structure (1) forming an outlet end face of the jet regulator (100).

* * * * *